US005507480A

United States Patent [19]

Martin et al.

[11] Patent Number: 5,507,480

[45] Date of Patent: Apr. 16, 1996

[54] FLAT OBJECT HOLDING DEVICE AND FLAT OBJECT UNSTACKING DEVICE EQUIPPED WITH THIS HOLDING DEVICE

[75] Inventors: Philippe Martin, Valence; Jean-Marc Teluob, Guilherand; Jean-Luc Astier, La Roche De Glun, all of France

[73] Assignee: Compagnie Generale D'Automatisme CGA-HBS, Bretigny Sur Orge, France

[21] Appl. No.: 309,145

[22] Filed: Sep. 20, 1994

[30] Foreign Application Priority Data

Sep. 27, 1993 [FR] France ..... 93 11458

[51] Int. Cl.[6] ..... B65H 3/12

[52] U.S. Cl. ..... 271/94; 271/104; 271/31.1

[58] Field of Search ..... 271/3.12, 11, 12, 271/10.03, 94, 96, 104, 31.1, 266, 272, 273, 274, 276

[56] References Cited

U.S. PATENT DOCUMENTS

| | | | |
|---|---|---|---|
| 2,856,187 | 10/1958 | Burckhardt et al. | 271/96 |
| 4,148,476 | 4/1979 | Brekell | 271/196 |
| 4,236,708 | 12/1980 | Matsuo | 271/12 |
| 4,357,007 | 11/1982 | Mens Franciscas et al. | 271/12 |
| 5,290,022 | 3/1994 | Sabatier et al. . | |
| 5,391,051 | 2/1995 | Sabatier et al. | 271/11 |

FOREIGN PATENT DOCUMENTS

| | | |
|---|---|---|
| 052582A1 | 2/1993 | European Pat. Off. . |
| 1267012 | 4/1968 | Germany . |
| 1904705 | 8/1970 | Germany . |
| 1263292 | 2/1972 | United Kingdom . |

*Primary Examiner*—H. Grant Skaggs

*Attorney, Agent, or Firm*—Sughrue, Mion, Zinn, Macpeak & Seas

[57] ABSTRACT

An automatic mail sorting flat object holding device has a driven perforated belt and suction grasping heads inside the belt. The holding device has a holding side consisting of the perforated belt moving in a predetermined transfer direction and to the front of which a stack of flat objects is offered up. A double pick separator has a suction head disposed substantially facing an exit edge of the holding side. The suction holding device has at least two substantially adjacent suction heads aligned in the transfer direction, one suction head of which is at least partly overlapping the double pick separator suction head.

3 Claims, 1 Drawing Sheet

FIG.1
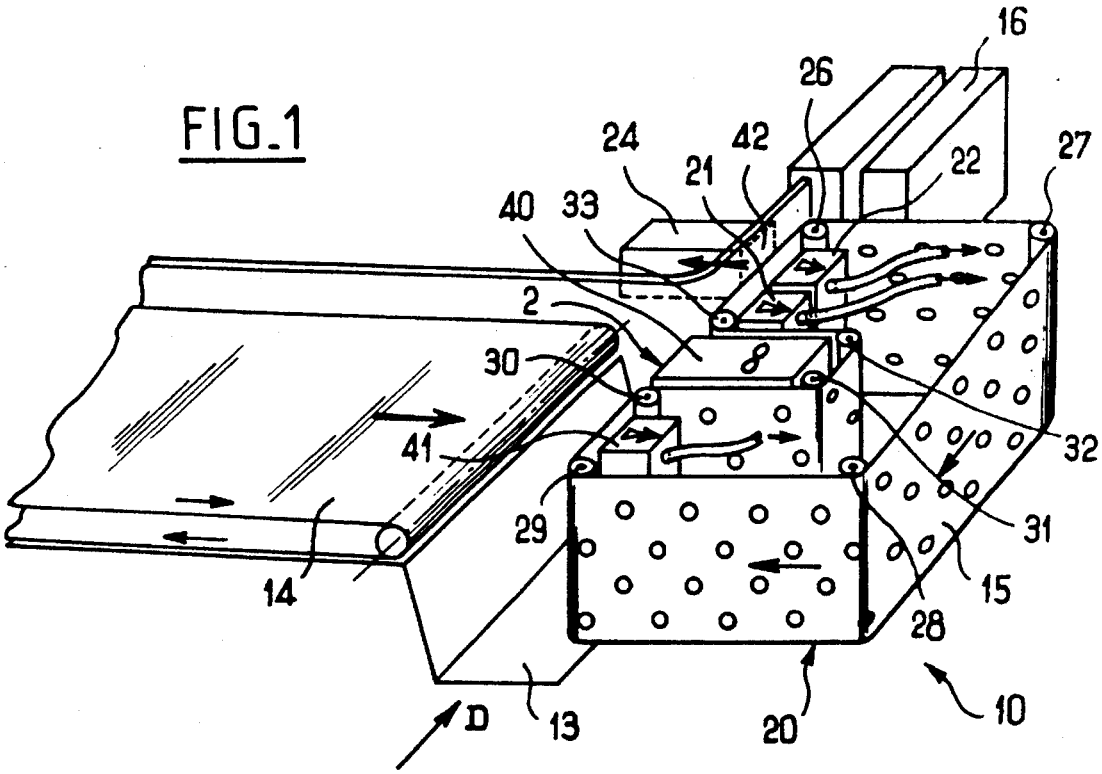
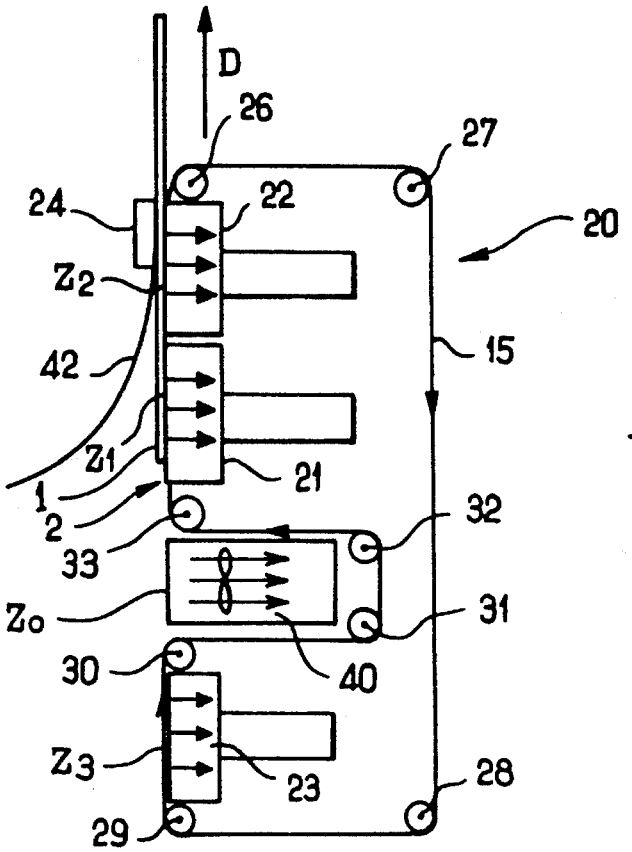
FIG.2

FLAT OBJECT HOLDING DEVICE AND FLAT OBJECT UNSTACKING DEVICE EQUIPPED WITH THIS HOLDING DEVICE

The present invention concerns a flat object holding device. It is also directed to a flat object unstacking device equipped with this holding device.

BACKGROUND OF THE INVENTION

A flat object unstacking device comprises four main units:

a mail feed magazine, a mail holding device, a double pick separator, a transfer or take-off device.

The mail is stood on edge on a belt with its back against a plate. The belt and the plate are driven so that the mail is moved towards the holding device. The belt leads to a sudden change in level, referred to hereinafter as the drop, and the mail then reaches a feed magazine between the conveyor belt and the holding device.

The holding device has suction areas across which a perforated belt passes.

On leaving the holding device the mail passes in front of the suction area of the double pick separator on the opposite side of the belt. This unit retains mail items that might otherwise be entrained by friction by the preceding mail item so that only one mail item at a time can leave.

On leaving the double pick separator the mail is taken into a transfer or take-off device which constitutes an interface between the unstacking device and a sorting device.

French patent application No 87 08519 in the name of this Applicant filed 18 Jun. 1987 discloses a holding device which has a sucker for grasping the first flat object from a stack of such objects offered up to it in order to move it to an exit position at which the flat object grasped is released.

The sucker described is a bellows type sucker made from a material such that when it has grasped the first flat object from the stack it is retracted by the effect of the suction and entrains with it the surface of the grasped object. This holding device has the disadvantage of a limited throughput.

French patent application No 91 09431 in the name of this Applicant filed 25 Jul. 1991 discloses a holding member comprising a perforated belt guided and driven by pulley-wheels. This holding member comprises a continuously operating suction chamber for prepositioning mail items to be unstacked and a suction head in the vicinity of a double pick separator device and a transfer device. This document also teaches the progressive running up to speed of the unstacked mail item in two stages to reduce the suddenness of unstacking, and this enables open mail items to be processed. A transfer unit and a double pick separator unit comprising retaining means are disposed in the immediate vicinity of the holding unit and the retaining means are actuated when the front edge of a mail item is taken up by the transfer unit.

U.S. Pat. No. 4,357,007 granted 2 Nov. 1982 discloses a holding device comprising two suction devices disposed behind a perforated belt and two sensors adapted to activate one of the suction devices according to the position of the first unstacked mail item.

In processing thin and floppy mail items the problem arises of the antagonistic actions of the holding device and the retaining means of the double pick separator. This can crumple a floppy flat object. It is therefore important for the mail items to be held for as long as possible as they move past the double pick separator.

OBJECTS AND SUMMARY OF THE INVENTION

An object of the present invention is to solve this problem by proposing a flat object holding device comprising a perforated belt driven by drive means, suction grasping means inside said belt, and a holding side across which said belt moves in a predetermined transfer direction and adapted to receive the first object from a stack of flat objects, and double pick separator means being disposed substantially facing an exit edge of said holding side.

In the flat object holding device of the invention the suction grasping means comprise at least two substantially adjacent suction heads aligned in said transfer direction, one of said suction heads at least partly facing the double pick separator means.

Using more than one suction area holds onto the flat object taken up by the holding device for as long as possible as it moves past the device and this prevents it being crumpled.

In a preferred embodiment of a holding device of the invention further comprising means for generating on its holding side a low suction high flowrate area, the adjacent suction heads are disposed between said low suction high flowrate generator means and the end of said holding side near the double pick separator means.

In another aspect, the invention proposes a flat object unstacking device comprising feed means, a flat object holding device of the invention, double pick separator means and transfer means, wherein the holding device comprises at least two suction heads aligned in the transfer direction.

BRIEF DESCRIPTION OF THE DRAWINGS

Other features and advantages of the invention emerge in the following description. In the appended drawings given by way of non-limiting example:

FIG. 1 is an overall view of a device for unstacking flat objects equipped with a holding device of the invention; and FIG. 2 is a top view of a flat object holding device of the invention.

MORE DETAILED DESCRIPTION

A flat object unstacking device equipped with a holding device of the invention and the operation of the holding device will now be described with reference to FIGS. 1 and 2.

The unstacking device 10 comprises conveyor means, such as a moving belt 14, a feed magazine 13, a holding device 20 of the invention, a double pick separator device 24 and a transfer device 16.

The holding device 20 comprises a perforated belt 15 driven by drive means (not shown) around a set of pulley-wheels 26–33 whose axes are substantially parallel. For example, their axes can be perpendicular to the surface of the belt 14 and to the substantially plane bottom of the feed magazine 13. Arrangements without this perpendicular relationship are equally feasible. The holding device 20 has on one side of the feed magazine 13 a substantially vertical holding side 2 against which the first flat object from a stack of flat objects is pressed by forces generated in a low suction high flowrate area $Z_0$. This area $Z_0$, which is substantially at the center of the holding side 2, is designed to attract the first mail item from the stack of mail items in the magazine 13.

The low suction is generated by a continuously operating fan 40 outside the path of the perforated belt 15.

The remainder of the description refers to a transfer direction D in which the mail items are moved by the holding device. This transfer direction is also that in which the perforated belt 15 moves across the holding side 2 of the holding device. The upstream and downstream directions referred to hereinafter are relative to the upstream to downstream transfer direction.

Two high suction areas $Z_1$, $Z_2$ are situated on the downstream side of the low suction area $Z_0$ and a third high suction area Z3 is situated on the upstream side of said low suction area $Z_0$. The three high suction areas are behind the perforated belt 15 and are generated by respective suction heads 21, 22, 23.

The function of the third suction area Z3 is to retamp offset mail items. The first and second areas $Z_1$ and $Z_2$ draw the mail items towards the transfer device 16. The various pulleywheels 26–33 are disposed inside the holding device to circumvent the low suction area $Z_0$ and to encompass the suction heads 21, 22, 23. To simplify FIGS. 1 and 2 the suction generating devices have been omitted. Conventional suction generating means to be used in a holding device of the invention can be selected to suit available energy supplies.

The suction in the two high suction areas $Z_1$ and $Z_2$ and the retamping area Z3 is controlled by solenoid valves (not shown). These areas move the objects in the transfer direction.

The first and second suction areas $Z_1$ and $Z_2$ are preferably adjacent and fill as closely as possible the gap between the low suction area and the suction head of the double pick separator device 24. This ensures that a mail item is held firmly until it is taken up by the double pick separator device 24 and the transfer device 16.

The perforations in the belt 15 enable application to the first object on the stack held in the feed magazine 13 of the suction forces generated by the various suction heads 21, 22, 23. When an object 1 is grasped by the holding device 20 it is drawn in the transfer direction D towards the transfer device 16 by the perforated belt 15. The second suction head 22 is preferably aligned with facing, and at least partly overlapping the suction head of the double pick, the separator device 24 on a wall 42 facing the holding side 2 of the holding device 20 to enable at least partial compensation of retaining forces generated by the suction head of the separator device 24 by suction forces generated in the second suction area 22. This is very important if only one floppy mail item is being processed. Because the second suction head 22 is there, the floppy mail item passes through the double pick separator freely and in particular without becoming crumpled.

The drive means for the perforated belt 15 can be designed to run the belt up to speed for each unstacking operation in accordance with a predetermined ramp function.

Of course, the invention is not limited to the embodiments just described which can be modified in many ways without departing from the scope of the invention. For example, the number of suction areas can be greater than two in order to enhance further the progressive transfer of a floppy flat object. The path of the perforated belt can also be different.

We claim:

1. Flat object holding device comprising a perforated belt driven by drive means, suction grasping means inside said belt, a holding device holding side across which said belt moves in a predetermined transfer direction and adapted to receive a first object from a stack of flat objects, double pick separator means including a suction head being disposed substantially facing an exit edge of said holding side, said suction grasping means comprising at least two substantially adjacent suction heads aligned in the transfer direction, one of said suction grasping means suction heads facing and at least partly overlapping the suction head of said double pick separator means to enable at least partial compensation of retaining forces generated by the suction head of the separator device by suction forces generated in said one of said suction grasping means suction heads thereby permitting a floppy mail item to pass through the double pick separator freely without becoming crumpled.

2. Holding device according to claim 1 further comprising means for generating on said holding side a low suction high flowrate area and wherein said adjacent suction heads are disposed between said low suction high flowrate area and the end of said holding side adjacent the double pick separator means.

3. Flat object unstacking device comprising a feed magazine and a flat object holding device adjacent the feed magazine, said flat object holding device comprising a perforated belt driven by drive means, suction grasping means inside said belt, a holding device holding side across which said belt moves in a predetermined transfer direction and adapted to receive a first object from a stack of flat objects, double pick separator means including a suction head being disposed substantially facing an exit edge of said grasping side, said suction grasping means comprising at least two substantially adjacent suction heads aligned in the transfer direction, one of said suction grasping means suction heads facing and at least partly overlapping the suction head of said double pick separator means to enable at least partial compensation of retaining forces generated by the suction head of the separator device by suction forces generated in said one of said suction grasping means suction heads, thereby permitting a floppy mail item to pass through the double pick separator freely without becoming crumpled.

* * * * *